United States Patent [19]

Geeting

[11] Patent Number: 4,942,923

[45] Date of Patent: Jul. 24, 1990

[54] APPARATUS FOR ISOLATING A TESTING ZONE IN A BORE HOLE SCREEN CASING

[76] Inventor: Marvin D. Geeting, 5524 Cresthill Dr., Fort Wayne, Ind. 46804

[21] Appl. No.: 347,504

[22] Filed: May 4, 1989

[51] Int. Cl.[5] ..... E21B 33/124; E21B 49/08

[52] U.S. Cl. ..... 166/250; 166/264; 166/387; 166/144; 166/180; 166/191

[58] Field of Search ..... 166/250, 264, 387, 139, 166/144, 149, 180, 191

[56] References Cited

U.S. PATENT DOCUMENTS

| | | | |
|---|---|---|---|
| 2,711,220 | 6/1955 | Simmons | 166/191 X |
| 3,871,218 | 3/1975 | Louis | 73/155 |
| 3,908,454 | 9/1975 | Mullins et al. | 73/155 |
| 4,146,094 | 3/1979 | Benedum et al. | 166/139 X |
| 4,171,642 | 10/1979 | Taylor | 73/155 |
| 4,635,717 | 1/1987 | Jageler | 166/250 |
| 4,803,874 | 2/1989 | Marrast et al. | 73/155 |
| 4,811,599 | 3/1989 | Johnson et al. | 73/155 |

FOREIGN PATENT DOCUMENTS

| | | |
|---|---|---|
| 262730 | 3/1962 | Australia . |
| 49349 | 4/1938 | France . |
| 55-65637 | 5/1980 | Japan . |

*Primary Examiner*—William P. Neuder

*Attorney, Agent, or Firm*—George Pappas

[57] ABSTRACT

An apparatus for isolating a testing zone in a bore hole screen casing includes a lower plug member sealingly positionable at a desired longitudinal point within the casing and an upper plug that is independent of the lower plug is also sealingly positionable at another desired point along the longitudinal bore of the screen casing. The isolated test zone is defined between the lower and upper plug members and both the longitudinal length of the isolated test zone and the location of the test zone are selectively variable. A fluid carrying conduit is connected to the upper plug member and is in communication through a bore in the upper plug member with the isolated test zone for accessing and sampling fluid therein.

19 Claims, 2 Drawing Sheets

APPARATUS FOR ISOLATING A TESTING ZONE IN A BORE HOLE SCREEN CASING

TECHNICAL FIELD

The present invention generally relates to isolating a zone within a well or bore hole for testing or sampling the zone and determining the characteristics of the zone or the fluid or vapor content thereof. More specifically, the present invention relates to an apparatus and method where through an isolated testing zone may be created in a screen casing. The longitudinal length of the isolated test zone, as well as the location of the test zone in the screen casing are selectively controlled.

BACKGROUND OF THE INVENTION

It is quite often desirable to test or sample a bore hole or well for determining the characteristics of a zone, such as pressure, or for determining the content of a fluid or, vapor or gas flowing therein. Hereinafter, fluids, vapors and gases are collectively referred to as fluids. More recently, the sampling of ground water has become vital in view of toxic and other contaminant pollution. Because the earth is made of various different formations or layers of materials, ground water and other fluids within the earth, in general, travel in these specific layers. It is often quite difficult if not impossible, without physical excavation, to determine the size and location of specific layers, let alone determining the contents of the fluid flowing therethrough. However, it is important to locate such layers or formations so that, for example, a layer or formation that has been contaminated by toxic waste may be located and action taken for the prevention of harm to life. Other reasons for locating specific layers include locating a formation or layer containing or leading to minerals or other valuable commodities, such as petroleum.

Various devices have been conceived and utilized in the past for isolating a zone within a bore hole or well and testing or sampling the fluid of the isolated zone. These devices, in general, include a lower and an upper packer that through, for example, air pressure, create a seal with the well casing or bore hole surface and fluid from the isolated test zone is drawn as needed. However, the packers of these devices are fixed at a given distance from one another and, therefore, although the zone location within the bore hole or well may be varied, the longitudinal length of the test zone cannot. This presents a serious drawback because earth formations vary in thickness and, as a consequence, an accurate sampling of a specific layer is quite often difficult to obtain without varying the longitudinal length of the test zone.

Prior art devices are also undesirable in that they quite often require a pressurized air supply for operation. Further, a positive seals between the well casing and the packers are quite often not provided and, as a consequence, the sampling is inaccurate in that it includes fluid from outside the test zone that has leaked through the seals. Aside from the inconvenience of having to utilize a pressurized air supply, because the strength of the well casing varies along the longitudinal length thereof and the air pressure to the packers is not often accurately controlled, the well or screen casing is quite often broken rendering the well or screen substantially useless.

Accordingly, a need exists for an apparatus for isolating a testing zone in a bore hole casing wherein the longitudinal length of the test zone as well as the location of the test zone in the casing is selectively variable. The plugs or packers used for creating the test zone should be easy to operate without the need for pressurized air and should provide a positive seal between the plug or packer and the casing. Further, the apparatus must generally be inexpensive to manufacture yet generally easy to operate, reliable, and long lasting.

SUMMARY OF THE INVENTION

It is the principal object of the present invention to overcome the above-discussed disadvantages associated with earlier devices for isolating a testing zone in a bore hole casing.

In summary, the present apparatus for isolating a testing zone includes a lower plug member that is selectively placeable within a screen casing at a first desired selected point along the longitudinal length of the screen casing. The lower plug member includes an expansion or elastic sleeve with a threaded bore. A core member with exterior threads that longitudinally increase in diameter is threadingly received within the expansion sleeve threaded bore. A tool engages the core member when placing the lower plug member within the casing and, upon placing the lower plug member at a first selected point within the screen casing, the core member is turned with the tool causing the core member to threadingly engage the expansion sleeve and causing the expansion sleeve to increase in diameter and positively sealingly engaging the inner surface of the screen casing. The seal between the sleeve and screen casing also frictionally retains the lower plug member at the selected first point along the longitudinal length of the casing. Thereafter, the tool is disengaged from the lower plug core and is removed from within the screen casing leaving the lower plug member at the first selected point.

The apparatus further includes an upper plug member that is quite similar to the lower plug member and is placed within the screen casing at a second selected point along the longitudinal length of the casing above the lower plug member. The upper plug member includes an expansion sleeve and core member similar to the lower plug member and, thus, a positive seal is provided at the second selected point in a similar fashion. An isolated test zone is defined between the lower and the upper plug members. The upper plug member includes a bore in communication with the defined isolated test zone, and a fluid conduit is connected to the upper plug member and communicate with the isolated test zone through the upper plug member bore. Fluid can, thus, be drawn or pushed in or out of the defined isolated test zone through the fluid conduit.

A retaining member is attached to each of the upper and lower plug core members and is larger in diameter than the sleeve threaded bore. This retaining member acts to retain the sleeve with the core member when the sleeve is threadably detached from the core member.

In one form thereof, the present invention is directed to an apparatus for isolating a testing zone in a bore hole screen casing. The apparatus includes a lower plug member selectively placeable within the screen casing at a first selected point along the longitudinal length of the screen casing for fluidly sealing the screen casing thereat and preventing fluid flow upwardly or downwardly through the screen casing. An upper plug member is provided and is selectively placeable, independent of the lower plug member, within the screen casing at a second selected point along the longitudinal length of the screen casing above the lower plug member for fluidly sealing the screen casing thereat and preventing fluid flow upwardly or downwardly through the screen casing. An isolated test zone is defined between the lower and upper plug members. The upper plug member has a bore therethrough in communication with the defined isolated test zone and a fluid conduit member communicating with the isolated test zone through the upper plug member bore is provided and extends out of the screen casing for accessing and drawing or pushing fluid in or out of the defined isolated test zone.

In one form thereof, the present invention is directed to a method of isolating a testing zone in a bore hole screen casing. The method includes placing a lower plug member within the screen casing at a first selected point along the longitudinal length thereof and fluidly sealing the screen casing thereat and preventing fluid flow upwardly or downwardly through the screen casing. Thereafter, an upper plug member having a bore therethrough communicating with a fluid conduit is placed within the screen casing at a second selected point along the longitudinal length thereof above the lower plug member and fluidly sealing the screen casing thereat and preventing fluid flow upwardly or downwardly through the screen casing thereby isolating a testing zone between the lower and upper plug members. Finally, the isolated testing zone is fluidly accessed through the fluid conduit and the upper plug member bore.

BRIEF DESCRIPTION OF THE DRAWINGS

The above-mentioned and other features and objects of this invention and the manner of obtaining them will become more apparent and the invention itself will be better understood by reference to the following description of a preferred embodiment of the invention taken in conjunction with the accompanying drawings wherein.

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DETAILED DESCRIPTION OF THE PREFERRED EMBODIMENT

Figure 1:
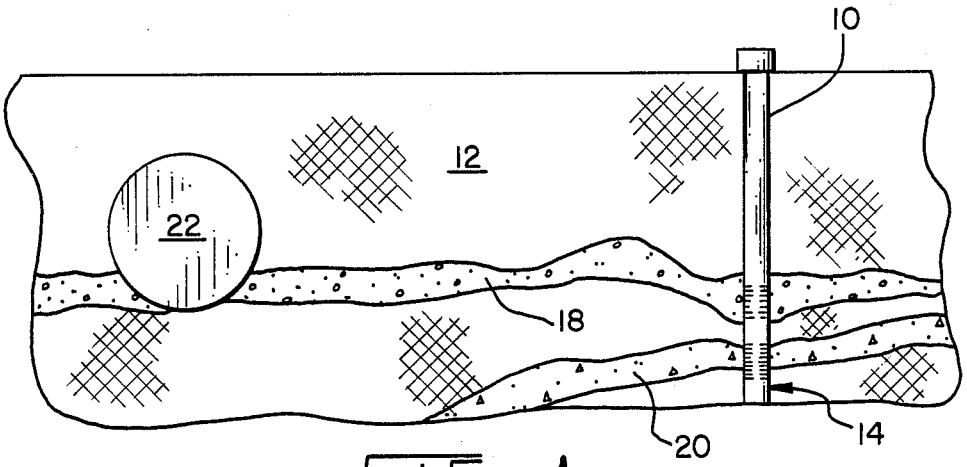
FIG. 1 is a cross-sectional view of an earth formation showing a bore hole screen casing in place wherein the apparatus, according to the present invention, may be utilized.

Referring to FIG. 1, there is shown a polyvinyl chloride (PVC) well casing 10 placed within a bore hole formed in earth formation 12. PVC well casing 10 includes a screen casing portion 14 having openings or slits 16 where through fluid in the earth formation 12 may travel to within the screen and well casing. Earth formation 12 is shown as being made of a generally non-porous material except for layers 18 and 20. A tank 22 is buried within earth formation 12 and houses a potentially dangerous fluid material. Accordingly, should a leak occur in tank 22, layer 18 may become contaminated and potentially flow to a populous area whereat harm would ensue. In this regard, the apparatus according to the present invention may be utilized for properly isolating layer 18 from, for example, herein shown layer 20 and properly and accurately sampling layer 18 for determining whether it has been contaminated by fluid from tank 22.

Figure 2:
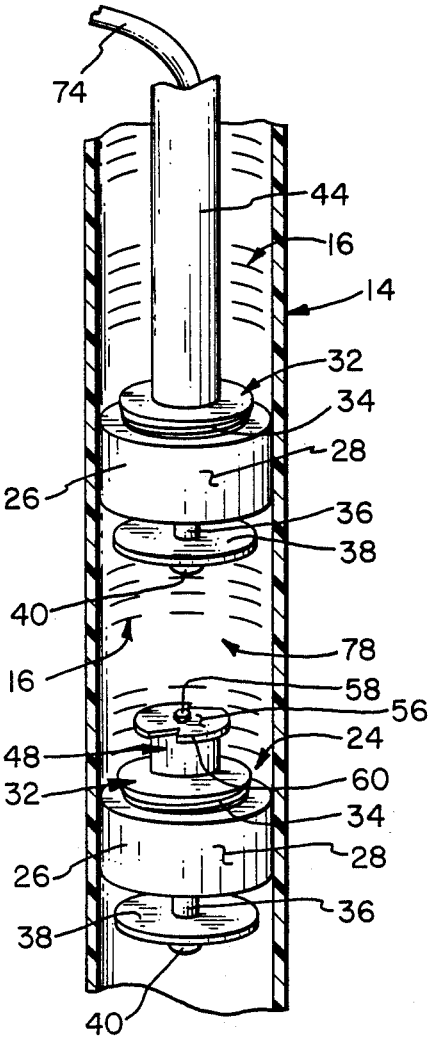
FIG. 2 is a cross-sectional view of the screen casing shown in FIG. 1 and showing the apparatus, according to the present invention, in perspective within the screen casing.
Figure 3:
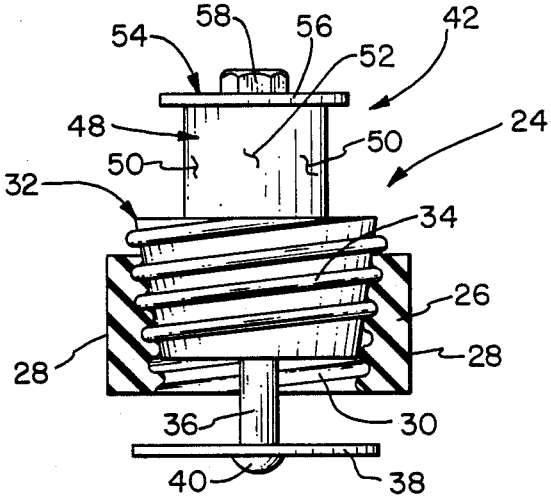
FIG. 3 is a partial cross-sectional elevational view of the lower plug member of the apparatus shown in FIG. 2.
Figure 4:
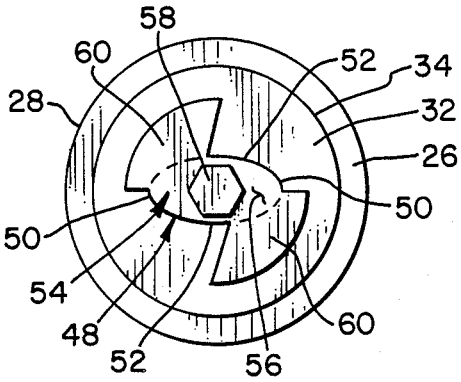
FIG. 4 is a top plan view of the lower plug member of the apparatus shown in FIG. 2.

As shown in FIG. 2, the apparatus according to the present invention includes a lower plug means or member generally indicated as 24 and selectively placeable within the screen casing 14 at a first selected point within screen casing 14 as shown. Plug member 24 includes an expansion or elastic sleeve 26 being generally cylindrically shaped and having a generally smooth exterior surface 28 and a threaded coaxial bore 30. Sleeve 26 is preferably made of a polyurethane elastomeric or an elastic rubber material. Plug member 24 also includes a core member 32 having, at one end thereof, exterior threads 34 adapted for mating engagement with threaded bore 30 of sleeve 26. Exterior threads 34, as shown in FIG. 3, longitudinally increase in diameter so that as core member 32 is turned with respect to sleeve 26 and threadingly received therein, sleeve 26 is forced to expand or elastically increase in diameter.

An elongate member 36 is attached to core member 34 at one end thereof. Elongate member 36 extends from its core attachment end through the sleeve threaded bore as shown in FIG. 3 and supports retaining member 38 on its other end thereof. Elongate member 36 is attached to core member 32, for example, by threading. Retaining member 38 is preferably disk-shaped like a washer and has a width or diameter greater than the diameter of threaded bore 30. Retaining member 38 is attached or supported on one end of elongate member 36, for example, by extending elongate member 36 through a hole in retaining member 38 and providing an enlarged portion 40 on elongate member 36 larger than the retaining member hole. Accordingly, retaining member 38 is supported or attached to core member 32 and is located on one end of the sleeve 26 generally opposite of the core member 32 so that when core member 32 is threadably detached from sleeve 26, retaining member 38 acts to retain sleeve 26 with core member 32.

At the other end of core member 32, on the larger threaded diameter portion, there is provided a tool engagement means or portion 42 adapted for selectively being engaged by a tool 44 having two radial prongs 46. Engagement portion 42 includes an oblong portion in cross-section 48 preferably being integral with the threaded portion of core member 32. Oblong portion 48 includes opposing distant surfaces 50 and nearby surfaces 52 from the core longitudinal axis. At the upper end of oblong portion 48, there is provided a catch means or member 54 adapted for selectively being latched by tool 44. Catch member 54 is generally made of a flat portion 56 made of steel or other suitable material and is attached to oblong portion 48 in a plane generally perpendicular to the distant and nearby surfaces 50 and 52 of oblong portion 48. Flat portion 56 is attached to oblong portion 48 via a screw 58 or other suitable means. Flat portion 56 further includes two engagement projections or ears 60 that extend past distant and nearby surfaces 50 and 52.

A typical tool 44 is shown in FIGS. 2 and 4–7 and includes a generally elongate tubular member 62 for extending from the earth formation surface to the points within the screen casing whereat the plugs are to be placed. Tubular member 64 has two radial prongs 46 radially extending inward at one end thereof. Radial prongs 46 are preferably allen screws threadingly received in threaded holes 64 in tubular member 62.

Figure 6:
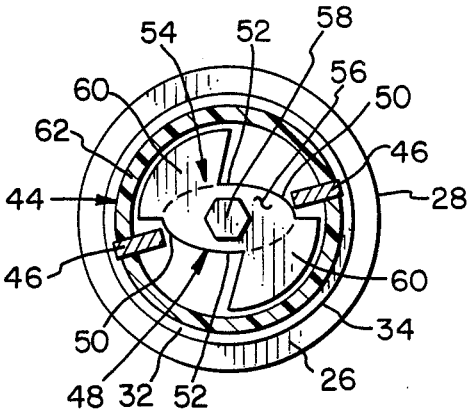
FIG. 6 is a top plan view of the lower plug member of the apparatus shown in FIG. 2 and showing the two radial prongs of the tool shown in FIG. 5 in position for threadingly inserting the core member into the sleeve and disengaging the tool from the core; and, FIG. 7 is a top plan view of the lower plug member as also shown in FIG. 6 except that the tool radial prongs are shown in position for engaging the engagement projections and for removing the lower plug member from within the screen casing.

In operation, the engagement member 42, in combination with the catch member 54, are used for selectively being engaged by the tool so that the core member 32 may be threaded in or out of sleeve 26 and also for selectively disengaging core member 32 from tool 44 when the lower plug member 24 is in the screen casing 14. In this fashion, the lower plug member 24 may be selectively placed within the screen casing 14 at the desired first selected point. That is, in operation, for placing lower plug member 24 at the first selected point, with core member 32 being unthreaded or generally out of sleeve 26, the tool 44 is slipped over the engagement portion 42 and, with the long handle or tubular portion 62 of tool 44, lower plug member 24 is pushed into screen casing 14 to the first selected point. Thereafter, as shown in FIG. 6, tool 44 is turned clockwise about its longitudinal axis forcing radial prongs 46 to engage distant surfaces 50 and, thus, threading core member 32 within sleeve 26. It should be noted that sleeve 26 is sized so that when core member 32 is not threaded therein there is sufficient frictional engagement with the interior surface of casing 14 so that sleeve 26 will not slip and turn as core member 32 is threadingly received therein. As described hereinabove, the threading engagement of core member 32 within sleeve 26 causes sleeve 26 to increase in diameter, thus, sealingly engaging the screen casing interior surface. As can be appreciated, the outward radial force placed on the sleeve 26 is generally proportional to the turning force placed on tool 44 and, therefore, a selected positive seal is provided between sleeve 26 and the interior surface of screen casing 14. In this fashion, screen casing 14 is fluidly sealed thereat and lower plug member 24 prevents fluid flow upwardly or downwardly through the screen casing 14. Further, the frictional forces between sleeve 26 and the interior surface of casing 14 act to keep plug member 24 at the first selected point. Plug member 24 may be left at the first selected point and tool 44 disengaged and removed from within screen casing 14 by merely placing radial prongs 46 in the radial position generally as shown in FIG. 6 whereat engagement projections 60 are not in the way when longitudinally pulling tool 44 and prongs 46 upwardly.

Figure 7:
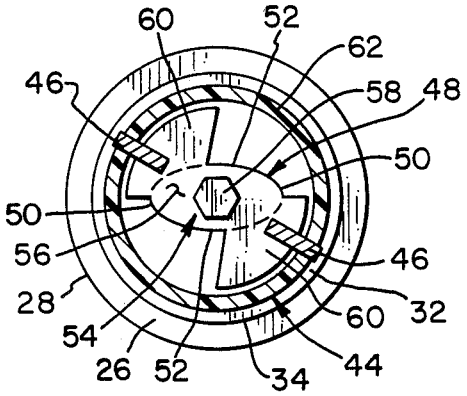

Lower plug member 24 can be removed from the screen casing or placed at a different first selected point by engaging the engagement portion 42 with tool 44 generally as shown in FIG. 7. Here, prongs 46 engage the distant surfaces 50 in a counterclockwise direction for threadingly removing core member 32 from within sleeve 26. In this fashion, sleeve 26 decreases in diameter allowing plug member 24 to be further pushed downwardly if desired via tool 44 or, in the alternative, pulled upwardly for the removal of plug member 24 or placement at a different first selected point. As shown in FIG. 7, when pulling plug member 24 upwardly, radial prongs 46 engage catch member 54 engagement projections 60 and, thus, transferring the necessary upward force 0 to core member 32 for upward movement thereof. In the event that sleeve member 26 is completely disengaged from core member 32, retaining member 38, as described hereinabove, acts to retain sleeve 26 with core 32 during the upward movement of plug 24.

Figure 5:
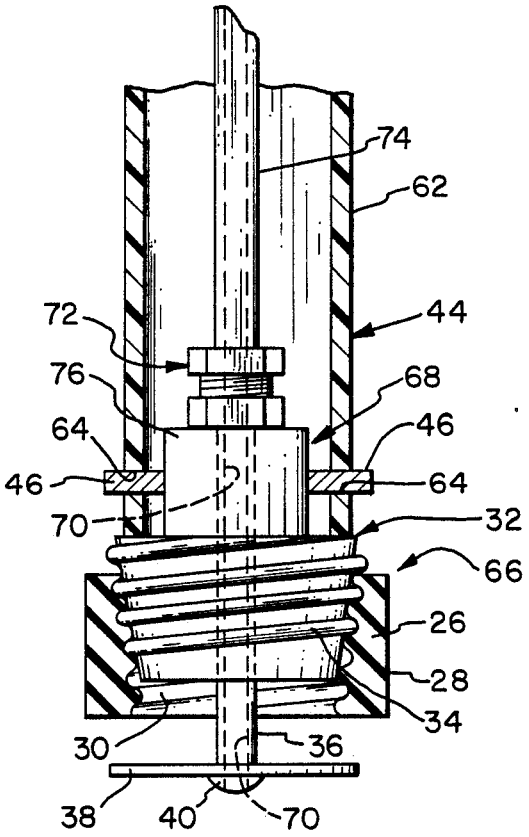
FIG. 5 is a cross-sectional elevational view of the upper plug member of the apparatus shown in FIG. 2 and showing a cross-section view of a typical tool used in conjunction with the apparatus.

The upper plug means or member 66, as shown in FIG. 5, is generally substantially similar to lower plug member 24 in that it is provided with a sleeve 26, elongate member 36, retaining member 38, and core member 32. However, upper plug member 66 is shown with an engagement means or portion 68 different from engagement portion 42. Further, upper plug member 66 includes a bore 70 therethrough that, more specifically, extends through enlarged portion 40 of elongate member 36 and through elongate member 36, core member 32, and engagement portion 68. At the upper end of engagement portion 68 there is provided a coupling 72 where through fluid conduit means or member 74 is connected to upper plug member 66 and where through conduit 74 is in communication with bore 70.

The engagement portion 68 of upper plug member 66 is different than the engagement portion 42 in that radial screws 46 are tightened against a generally solid portion 76 that is integral with core member 32. Solid portion 76 is preferably cube-shaped, however, may also be cylindrical or shaped in any suitable fashion for accommodating the tightening of screws or radial prongs 46 thereon. As can be appreciated, the attachment of tool 44 with screws 46 onto portion 76 allows for the placement of upper plug member 66 at a second selected point along the longitudinal length of screen casing 14 and by threading its core member 32 in or out of sleeve 26, upper plug member 66 also fluidly seals the screen casing at the second selected point in the same fashion as the lower plug member 24. Thus, upper plug member 66, upon placement at the desired second selected point and threading of core member 32 within sleeve 26, acts to prevent fluid flow upwardly or downwardly through the screen casing thereat and, in combination with the lower plug member 24, creates an isolated test zone 78 therebetween. The fluid conduit member 74 communicates through bore 70 with the defined isolated test zone 78 and, thus, fluid may be accessed and drawn or pushed out or in of the defined isolated zone 78 by means provided on the surface of earth formation 12.

It should be noted that if tool 44 must be disengaged from upper plug member 66 for leaving upper plug member 66 within the screen casing, an engagement means 42 as used with the lower plug member 24, may be used in conjunction with upper plug member 66. In this fashion, the fluid conduit 74 would remain extending from upper plug member 66 to out of from within the screen casing 14 and sampling of the isolated test zone 78 may be done over a long period of time and without tool 44 being within screen casing 14.

The apparatus according to the present invention provides for a method of isolating a testing zone in a bore hole screen casing that is generally reliable and allows the longitudinal length of the test zone as well as the location of the test zone within the screen casing to be variable. In usage, the lower plug member 24 is first placed within the screen casing 14 at a first selected point along the longitudinal length of the screen casing 14 as shown in FIG. 2. Tool 44 is then turned thereby turning the core member 32 for forcing the core member 32 within sleeve 26 and also increasing the diameter of sleeve 26 so that the sleeve 26 sealingly engages the interior surface of the screen casing 14. Tool 44 is then disengaged from the lower plug member 24 by placing the radial prongs 46 in the position shown in FIG. 6 and pulling tool 44 out from within screen casing 14. Thereafter, the upper plug member 66 is placed within the screen casing 14 at a second selected point along the longitudinal length of screen casing 14 as shown in FIG. 2. The core member 32 of upper plug member 66 is turned with tool 44 in the same fashion as the lower plug member and thereby fluidly sealing the screen casing at the second selected point and preventing fluid flow upwardly or downwardly through the screen casing thereat. Thus, an isolated testing zone 78 is defined between lower plug member 24 and upper plug member 66. The isolated test zone 78 is accessed through the fluid conduit 74 and upper plug member bore 70. As can be appreciated, the steps of placing both lower and upper plug members and sealing thereat can be repeated as necessary for locating and isolating a desired testing zone.

While the sleeves 26 are preferably made of polyurethane elastomeric or rubber material, the cores 32 are preferably made of a plastic such as PVC and the retaining members 38 and elongate members 36 are preferably made of stainless steel or brass.

While the invention has been described as having a specific embodiment, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus for isolating a testing zone in a bore hole screen casing, said apparatus comprising:

lower plug means selectively placeable within the screen casing at a first selected point along the longitudinal length thereof for fluidly sealing the screen casing thereat and preventing fluid flow upwardly or downwardly through the screen casing;

upper plug means being detached from said lower plug means and selectively placeable independent of said lower plug means within the screen casing at a second selected point along the longitudinal length thereof above said lower plug means for fluidly sealing the screen casing thereat and preventing fluid flow upwardly or downwardly through the screen casing, whereby an isolated test zone is defined between said lower and upper plug means;

said upper plug means having a bore therethrough in communication with said defined isolated test zone; and, fluid conduit means communicating with said isolated test zone through said upper plug means bore and extending out of the screen casing for accessing said defined isolated test zone.

2. The apparatus of claim 1 wherein said lower plug means includes an expansion sleeve having a threaded bore and a core member having exterior threads longitudinally increasing in diameter and engaging said sleeve threaded bore, whereby said sleeve expands and increases in diameter for sealingly engaging the screen casing as said core is threadingly received in said sleeve threaded bore.

3. The apparatus of claim 2 wherein said lower plug core includes a tool engagement means for selectively being engaged by a tool whereby said core may be threaded in or out of said sleeve with the tool, and for selectively being disengaged from the tool when said lower plug means is in the screen casing whereby said lower plug means may be selectively placed within the screen casing at the first selected point.

4. The apparatus of claim 3 wherein said engagement means includes an oblong portion in cross-section having opposing distant and nearby surfaces from the core longitudinal axis and catch means on said core for selectively being latched by the tool whereby two radial prongs on the tool engage said distant surfaces for turning said core about its longitudinal axis and threading said core in or out of said sleeve and whereby the two radial prongs selectively engage said catch means for removing said lower plug means from the screen casing.

5. The apparatus of claim 4 wherein said catch means includes a flat portion in a plane generally perpendicular to said distant and nearby surfaces of said oblong portion, said flat portion including an engagement projection whereat a radial prong of the tool engages said flat portion.

6. The apparatus of claim 2 further comprising a retaining member having a width greater than the diameter of the sleeve threaded bore, said retaining member attached to said core member and located on one end of said sleeve opposite said core member, whereby said sleeve is retained with said core when said core is threadably detached from said sleeve.

7. The apparatus of claim 6 wherein an elongate member is attached to said core on one end thereof and extends through said sleeve threaded bore, said retaining member being supported on said elongate member other end thereof.

8. The apparatus of claim 2 wherein said expansion sleeve is made of a polyurethane elastomeric material and said core member is made of plastic.

9. The apparatus of claim 1 wherein said upper plug means includes an expansion sleeve having a threaded bore and a core member having exterior threads longitudinally increasing in diameter and engaging said sleeve threaded bore, whereby said sleeve expands and increases in diameter for sealingly engaging the screen casing as said core is threadingly received in said sleeve threaded bore.

10. The apparatus of claim 9 wherein a tool is connected to said upper plug core for selectively threading said core in or out of said sleeve and for selectively inserting or removing said upper plug means in the screen casing.

11. The apparatus of claim 9 further comprising a retaining member having a width greater than the diameter of the sleeve threaded bore, said retaining member attached to said core member and located on one end of said sleeve opposite said core member, whereby said sleeve is retained with said core member when said core is threadably detached from said sleeve.

12. The apparatus of claim 11 wherein an elongate member is attached to said core on one end thereof and extends through said sleeve threaded bore, said retaining member being supported on said elongate member other end thereof.

13. The apparatus of claim 12 wherein said upper plug means bore is located and extends through said core and attached elongate member.

14. The apparatus of claim 1 wherein said lower and upper plug means each include an expansion sleeve having a threaded bore and a core member having exterior threads longitudinally increasing in diameter and engaging said respective sleeve threaded bore, whereby said sleeves expand and increase in diameter for sealingly engaging the screen casing as said respective core is threadingly received in said respective sleeve threaded bore.

15. The apparatus of claim 14 wherein said lower plug core includes a tool engagement means for selectively being engaged by a tool whereby said core may be threaded in or out of said sleeve with the tool, and for selectively being disengaged from the tool when said lower plug means is in the screen casing and whereby said lower plug means may be selectively placed within the screen casing at the first selected point.

16. The apparatus of claim 14 wherein each of said upper and lower plug means include a retaining member having a width greater than the diameter of the respective sleeve threaded bores, each of said retaining members attached to said respective core members and located on one end of said sleeves opposite said core members whereby said sleeves are retained with said respective core when said core is threadably detached from said sleeve.

17. A method of isolating a testing zone in a bore hole screen casing comprising the steps of:

placing a lower plug member within the screen casing at a first selected point along the longitudinal length thereof and fluidly sealing the screen casing thereat and preventing fluid flow upwardly or downwardly through the screen casing; and, placing an upper plug member that is detached from the lower plug member and having a bore therethrough and communicating with a fluid conduit, within the screen casing at a second selected point along the longitudinal length thereof above the lower plug member and fluidly sealing the screen casing thereat and preventing fluid flow upwardly or downwardly through the screen casing thereby isolating a testing zone between the lower and upper plug members; and, fluidly accessing the isolated testing zone through the fluid conduit and upper plug member bore.

18. The method of claim 17 further comprising, after the step of placing the lower plug member, the step of turning, with a tool, a core member having exterior threads that longitudinally increase in diameter and engage an expansion sleeve threaded bore, and thereby expanding and increasing the sleeve diameter whereby the sleeve sealingly engages the screen casing, and disengaging the tool from the lower plug member and removing the tool from the screen casing.

19. The method of claim 18 further comprising after the step of placing the upper plug member, the step of turning, with a tool, a core member having exterior threads that longitudinally increase in diameter and engage an expansion sleeve threaded bore and expanding and increasing the sleeve diameter whereby the sleeve sealingly engages the screen casing.

* * * * *